US010011456B2

(12) United States Patent
Affaticati et al.

(10) Patent No.: US 10,011,456 B2
(45) Date of Patent: Jul. 3, 2018

(54) METHOD FOR IMPLEMENTING A CORRECT WINDING OF A WIRE ON A SPOOL

(71) Applicant: SAMP S.P.A. CON UNICO SOCIO, Bentivoglio (IT)

(72) Inventors: Artemio Affaticati, Busto Arsizio (IT); Enrico Conte, Bentivoglio (IT); Roberto Conte, Bentivoglio (IT)

(73) Assignee: SAMP S.P.A. CON UNICO SOCIO, Bentivoglio (IT)

( * ) Notice: Subject to any disclaimer, the term of this patent is extended or adjusted under 35 U.S.C. 154(b) by 92 days.

(21) Appl. No.: 15/300,761

(22) PCT Filed: Apr. 3, 2015

(86) PCT No.: PCT/IB2015/052468

§ 371 (c)(1),
(2) Date: Sep. 29, 2016

(87) PCT Pub. No.: WO2015/151073

PCT Pub. Date: Oct. 8, 2015

(65) Prior Publication Data

US 2017/0015519 A1 Jan. 19, 2017

(30) Foreign Application Priority Data

Apr. 3, 2014 (IT) ..... BO2014A0187

(51) Int. Cl.
*G06F 19/00* (2018.01)
*B65H 63/06* (2006.01)
(Continued)

(52) U.S. Cl.
CPC ..... *B65H 63/06* (2013.01); *B65H 54/22* (2013.01); *B65H 54/2878* (2013.01); *B65H 59/10* (2013.01)

(58) Field of Classification Search
CPC ..... B65H 63/06; B65H 54/22; B65H 59/10; B65H 54/2878
See application file for complete search history.

(56) References Cited

U.S. PATENT DOCUMENTS 2,597,375 A * 5/1952 Rinehart ..... B65H 54/22 242/474.8
4,004,744 A * 1/1977 Hoorelbeke ..... B65H 54/2866 242/478.2
(Continued)

FOREIGN PATENT DOCUMENTS

DE 19645992 5/1998
DE 102011015802 10/2012
(Continued)

OTHER PUBLICATIONS

Rodriguez, Abdel, et al. "Model-free learning of wire winding control." Control Conference (ASCC), 2013 9th Asian. IEEE, 2013.*

(Continued)

*Primary Examiner* — Michael D Masinick
(74) *Attorney, Agent, or Firm* — Matthew A. Pequignot; Pequignot + Myers

(57) ABSTRACT

Method for implementing a correct winding of a wire on a spool (100). The method also comprises a step for calculating the angular speed of a motor (43) displacing the wire dispensing device (40) according to the wire winding step and according to the dancer error, detected by a position sensor (35) that provides an analogical signal with respect to a zero position and to a tolerance value, in order to determine the presence of a possible "valley error", or of a possible "peak error". In this method, if during the spool winding, a "valley error" or a "peak error" is detected, the control device decides whether to slow down or to increase the
(Continued)

speed of the wire dispensing device (40) with the aim of filling the depression or skipping the peak.

5 Claims, 1 Drawing Sheet

(51) Int. Cl.

| | |
|---|---|
| ***B65H 54/28*** | (2006.01) |
| ***B65H 54/22*** | (2006.01) |
| ***B65H 59/10*** | (2006.01) |

(56) References Cited

U.S. PATENT DOCUMENTS

| | | | | |
|---|---|---|---|---|
| 6,443,386 | B1 * | 9/2002 | Bednarczyk | B65H 54/2854 242/477.1 |
| 7,370,823 | B2 * | 5/2008 | Lammermann | B65H 54/286 242/397.2 |
| 9,809,416 | B1 * | 11/2017 | Spruell | B65H 63/08 |
| 2007/0284472 | A1 * | 12/2007 | Lammermann | B65H 54/286 242/397.5 |
| 2017/0015519 | A1 * | 1/2017 | Affaticati | B65H 54/2878 |
| 2017/0247219 | A1 * | 8/2017 | Conte | B65H 54/2878 |

FOREIGN PATENT DOCUMENTS

| | | |
|---|---|---|
| JP | 2003341934 | 12/2003 |
| JP | 2006008310 | 1/2006 |
| WO | WO0039013 | 7/2000 |
| WO | WO 2004024606 | 3/2004 |

OTHER PUBLICATIONS

International Search Report, PCT/IB2015/052468, dated Jul. 3, 2015.

* cited by examiner

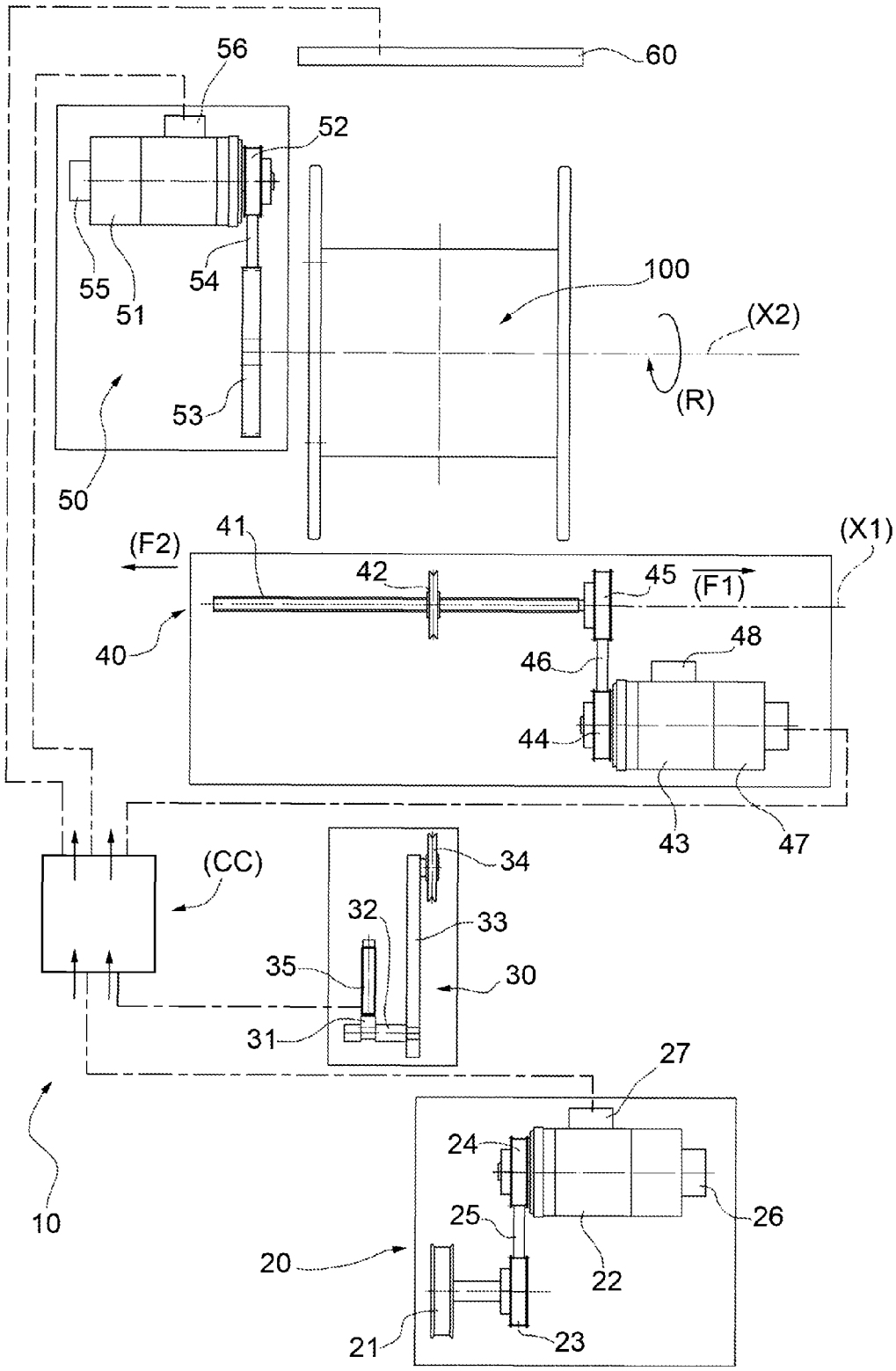
56
60
52
55
51
54
100
(X2)
(R)
53
50
41
(F2)
42
45
(F1)
(X1)
40
46
48
44
43
47
(CC)
34
32
33
35
30
31
27
24
26
25
22
10
20
21
23

METHOD FOR IMPLEMENTING A CORRECT WINDING OF A WIRE ON A SPOOL

RELATED APPLICATION DATA

This application is the national stage entry of International Application No. IB2015/052468, filed Apr. 3, 2015, which claims priority to Italy Patent Application No. BO2014A000187, filed on Apr. 3, 2014. All claims of priority to these applications are hereby made, and each of these applications is hereby incorporated in its entirety by reference.

TECHNICAL FIELD

The present invention relates to a method for implementing a correct winding of a wire on a spool.

Incidentally, it should be pointed out that the "wire" defined herein might be an insulated or non-insulated metal wire, an insulated or non-insulated strand, a string, filaments, glass fibres and the like.

STATE OF THE ART

As it is known, peaks and valleys in a spool winding are caused by irregularities of the surfaces of the core of the spool, by the progressive overlapping of the layers of wound wire, by the loosening of spool winding stretch due to problems in the path of the wire, etc.

The formation of peaks and valleys is also possible, furthermore, in the area of a flange of the spool due to an incorrect position of the flange itself; this is the case, for example, when the spool has an actual "spool winding working width" that is different from the pre-set one, taking into account the type of spool.

The formation of peaks and valleys is also encouraged by possible irregularities in the geometry of the flanges (for example, when there are deformed flanges); or by joints between the spool core and the flanges that are large compared to the diameter of the wire or to the size of the circle circumscribing it. Furthermore, the flanges can also deform during the progressive filling of the spool due to the thrust exerted by the wire hank.

Other causes for the formation of peaks and valleys can be, for example, a loosening and/or a delay in the movement of the wire due to an inversion of the direction of movement of the wire dispensing device, or possible wire dispensing irregularities due to the size; for example, a wire with a fairly large diameter tends to have an inertia that is hard to control.

Moreover, it is known that in the spool winding operation there is a constant fact to be taken into account, independent of the cross-section, namely the fact that the wire always tends to be late relative to the movement of the wire dispensing device that dispenses it. This phenomenon becomes more evident as the distance between the wire dispensing device and the spool increases and as the cross-section of the wire increases.

In standard applications, both when the wire dispensing assembly is mechanically connected to the rotation of the spool and when the wire dispensing assembly is controlled separately, the linear displacement speed of the wire dispensing device is kept constant within the single layer of wire wound. By so doing, in the end, there are no variations to the wire winding step for the different layers. Furthermore, during the progressive filling of the spool, the linear speed of the wire dispensing device decreases, so as to have a constant wire winding step as the diameter of the wire hank wound on the spool increases.

For example, U.S. Pat. No. 7,370,823 B2 (NIEHOFF) discloses a system that, by means of the correlation among:

- the speed of the wire;
- the value of the wire winding diameter, which is calculated or detected by means of one or more sensors mounted on the wire dispensing device; and
- the position and the angular speed of the spool (through a position or speed detector), is able to avoid the formation of peaks and valleys.

In the area of the flanges, the use of one or more sensors allows operators to detect their position and, by correlating the speed of the wire, the wire winding diameter and the angular position of the spool, one can define the presence of peaks and/or valleys and act upon the instant in which the movement of the wire dispensing device is inverted, so as to fill a valley (by delaying the moment of the inversion or by stopping the movement altogether) or so as not to deposit the wire (through an advance of the inversion instant).

Even if the system described in U.S. Pat. No. 7,370,823 B2 (NIEHOFF) allows operators to control the winding of the wire on the spool in a fairly precise manner, it turns out to be expensive and sometimes not very reliable because of the controls carried out by means of speed sensors.

OBJECT OF THE INVENTION

Therefore, the object of the present invention is to provide a method for implementing a correct winding of a wire on a spool, which is designed to eliminate the aforementioned drawbacks and, at the same time, can be manufactured in a straightforward and low-cost manner.

The method according to the present invention was conceived to obtain a higher quality in wire winding, in particular for the so-called "non-turn-to-turn" wire winding, in the presence of peaks or valleys on the spool winding surface and when there is the need to correct possible spool winding defects in the area of the spool flanges.

As it is known, we have a "turn-to-turn" process when the wire is wound in such a way that the sides of the wire touch each other. In this case, the wire winding step is equal to the wire diameter. Normally, in order to permit a better unwinding, manufacturers tend to increase the wire winding step (approximately 1.3-1.6 times the diameter), thus creating a crossing between one layer and the other.

The method according to the present invention is based on a different system, which preferably—though not necessarily—uses synchronous electric motors, in particular brushless motors with integrated drive (or decentralized drive, based on the size) and space control, as well as a pull control dancer and suitable sensors.

Therefore, the system uses the combination of effects due to the type of motors used, to the installation of one or more sensors to check the presence of the spool, to the control of the position of the dancer and to the correlation among the linear speed of the incoming wire, the "calculated wire winding diameter" (also called "servodiameter") and the position of the dancer detected through a suitable sensor.

As it is known, the "servodiameter" is the calculated diameter of a hank during the process with which the wire is wound on a spool.

When the spool is loaded into the machine, the operator places it on a loading device and controls its loading into the machine (the spool is brought to a height that allows it to be locked between two centres—manually or automatically controlled). At the end of this operation, before allowing the loading system to move downwards, the machine, through a "spool presence detector", checks—for safety reasons—whether the spool is correctly locked between the centres by detecting the position of the flanges. The parameters detected are compared with the data set in the machine and the operator checks whether the spool loaded into the machine corresponds to the type set in the "production recipe".

At the end of this operation, if all checks are positive, the loading device is allowed to move downwards.

Now an operator can fix the wire on the spool and the winding machine is ready to begin the spool winding operation.

The wire winding operation starts with the progressive acceleration of the machine from the zero speed to a certain pre-set production speed.

During the wire winding step, in a generic layer, the wire winding speed is calculated by correlating the linear speed of the wire with the servodiameter ("calculated wire winding diameter"), so as to the maintain the set wire winding stretch (defined by the type of wire). The set wire winding stretch is controlled by comparing the position of the dancer, detected by a suitable sensor, with the pre-set parameter.

The linear wire winding speed can be calculated with different methods:

- through a measurement of the linear speed of the wound wire and of the angular speed of the winding spool; the measure obtained must be properly filtered, so as to avoid wrong calculations due to measurement disturbances; or
- through the use of the diameter of the spool at the beginning of the winding and through a subsequent correction of the value of the outer diameter of the hank by means of the use of a dancer.

It should be pointed out that the dancer position sensor provides an analogical signal corresponding to a rotation of the lever that turns into a range in [mm] of a spring.

The parameter set in the type of wire is a expressed in N/mm2. The comparison is carried out on a software level, thus turning the range of the spring into a force (using the known equation F=k*x), which, related to the wire cross-section, provides the wire winding stretch. As it is known, the dancer might be mounted on a linear unit; in this case, the lever would carry out a translation displacement.

The dancer position sensor, instead of a spring, can comprise another device, for example a pneumatic cylinder having a given cross-section and supplied with air at a pressure that is adjusted by a suitable system, so as to have the requested wire winding stretch.

During the wire winding, the displacement speed of the wire dispensing device is defined by correlating the linear speed of the wire, the servodiameter and the wire winding step defined by the type of production.

In the presence of a valley or a peak and, therefore, of an instantaneous variation of the wire winding diameter compared to the servodiameter, the dancer moves, thus generating a variation of the position signal, which is interpreted as a presence of a peak or valley, which, hence, causes a variation of the displacement speed of the wire dispensing device.

During the progressive filling of a layer, the wire dispensing device, which can move crosswise, moves closer to the flange of the spool and a height corresponding to the position stored during the checks carried out to control the correct insertion of the spool is taken on as theoretical inversion position.

When the wire dispensing device moves closer to said theoretical height, if there is a peak or a valley (and, therefore, an instantaneous variation of the wire winding diameter compared to the servodiameter), the dancer moves, thus generating a variation of the position signal, which is interpreted as a presence of a peak or valley, which, hence, causes an advance or a delay in the inversion command compared to the theoretical instant. The neighbourhood in which to carry out this correction operation is defined in the technical parameters of the machine and is correlated to the type of spool.

Suitable control strategies were developed to correctly interpret the variation of position of the dancer, so as to obtain a correct elimination of peaks and valleys.

During the wire winding step, the mobile unit of the wire dispensing device can stop for accidental reasons.

In this case, the wire is wound in the same spot, thus piling up (crating the so-called "rough"), and, therefore, the dancer changes its angular position and the correlation between the position of the dancer and the displacement speed of the wire dispensing device allows the machine to stop, so as to avoid producing rejected items and so as to preserve the machine from accidental damages caused by the braking of the wire after it has piled up.

According to the present invention, there is provided a method according to independent claim 1 and, preferably, according to any of the Claims that directly or indirectly depend on the aforesaid independent Claim.

BRIEF DESCRIPTION OF THE FIGURES

The present invention, concerning a method, will be best understood upon perusal of the following description, with reference to a drawing that shows, in a schematic manner, a machine to wound a wire on a spool. As we will explain more in detail below, this machine is fitted with sensors, which are designed to control the method according to the present invention.

FAVOURITE EMBODIMENT OF THE INVENTION

In the accompanying FIGURE, number 10 indicates a machine to wind a wire on a spool 100, on which the method according to the present invention can be implemented.

The machine 10 comprises the following devices arranged in line:

(a) a feeding device 20 to feed a wire (not shown) to be wound around a spool 100; this feeding device 20 comprises, as it is known, a drawing die 21, which is caused to rotate by a synchronous electric motor 22 (for example, a brushless motor) by means of a pair of wheels 23, 24, which are connected to each other by a belt 25; the synchronous electric motor 22 is associated with a relative encoder 26 and is controlled by an electronic board 27;

(b) a dancer 30 comprising, in turn, a cam 31, which is mounted on a shaft 32, which pivots on a lever 33, on which there is mounted, in a rotary manner, a wire transmission pulley 34; the sensor 35 is not in contact with the surface of the cam 31; the sensor 35 provides an analogical signal, which depends on the distance of its reading head from the surface of the cam 31; therefore, the variation of the signal generated by the sensor 35 measures the variation of the distance of the surface of the cam 31;

(c) a wire dispensing device 40 comprising a worm screw 41 controlling the displacement of a pulley of the wire dispensing device along an axis (X1) and according one of the two directions defined by arrows (F1) and (F2); the worm screw 41 is caused to rotate by a synchronous electric motor 43 (for example, a brushless motor) by means of a pair of wheels 44, 45, which are connected to each other by a belt 46; the synchronous electric motor 43 is associated with a relative encoder 47 and is controlled by an electronic board 48;

(d) a spool assembly 50 comprising the above-mentioned spool 100, on which the wire (not shown) is wound so as to form a wire hank (not shown); the spool assembly 50 comprises, furthermore, a relative synchronous electric motor 51, which causes the spool 100 to rotate (around an axis (X2)—arrow (R)) by means of a pair of wheels 52, 53, which are connected to each other by means of a belt 54; the synchronous electric motor 51 is associated with a relative encoder 55 and is controlled by an electronic board 48; and (e) a sensor 60, which is designed to read the position of the spool 100 and the conformation of its wire containing flanges; in particular, preferably, though not necessarily, the sensor 60 is not mounted on the wire dispensing assembly 40.

Incidentally, it should be pointed out that each electronic board 27, 48, 56, coupled to the respective encoder 26, 47, 55, fulfils both power control functions (since it is used to turn direct current into alternating current) and mere software control functions concerning the data received/sent from/to the respective encoder 26, 47, 55.

In a preferred solution of the invention, a DC bus architecture is used.

However, with greater construction complexities, the same operation might be obtain booth with DC motors and AC/DC converters and with AC motors and AC/AC converters.

The electronic boards 27, 48, 56, the analogical sensor 35 and the spool control sensor 60 are electronically connected to an electronic control unit (CC), which can be integrated in the machine 10 or not and manages all the functions used to control the components of the machine 10.

The method according to the present invention comprises the following steps:

(f1) setting the main geometrical data of the spool on an operation panel of the electronic control unit (by means of dedicated formulas or by means of manually entered data);

(f2) loading a spool on the machine;

(f3) acquiring the position of the spool flanges by means of a sensor;

(f4) calculating the actual spool position and comparing it with the "spool data" set in advance in the electronic control unit in order to check whether the spool loading was successful and whether the spool is consistent with what expected;

(f5) keeping on if the check is positive; or stopping and reporting the problem by means of an alarm signal;

(f6) manually binding the wire to the spool; an operator starts the production by activating a specific command;

(f7) detecting the dancer position and transforming the measured value into a measure of wire tension based on the geometry and structure of the dancer;

(f8) calculating the servodiameter according to the spool data, the production data and the dancer position; and (f9) calculating the speed of the spool motor according to the servodiameter with the aim of maintaining a constant winding tension.

The method comprises a further step for calculating the angular speed of a motor displacing the wire dispensing device according to the wire winding step and according to the dancer error, detected by a position sensor that provides an analogical signal with respect to a zero position and to a tolerance value, in order to determine the presence of a possible "valley error", or of a possible "peak error". In this method, if, during the spool winding, a "valley error" or a "peak error" is detected, the control device decides whether to slow down or to increase the speed of the wire dispensing device with the aim of filling the depression or skipping the peak.

The main advantage of the method according to the present invention lies in its reliability. Furthermore, in order to implement the method according to the present invention, it is sufficient to have a winding machine, in which a small number of sensors is provided. In addition, the solution according to the present invention prevents the operator of the winding machine from having to continuously/frequently correct the inversion parameters of the wire dispensing device, thus reducing the time that the operator has to spend working on a single machine. In this way, each single operator can increase the number of winding machines that he/she can manage.

The invention claimed is:

1. Method for implementing a correct winding of a wire on a spool, said method comprising the following steps:

(f1) setting the main geometrical data of the spool on an operation panel of the electronic control unit (by means of dedicated formulas or by means of manually entered data);

(f2) loading a spool on the machine;

(f3) acquiring the position of the spool flanges by means of a sensor;

(f4) calculating the actual spool position and comparing it with the "spool data" set in advance in the electronic control unit in order to check whether the spool loading was successful and whether the spool is consistent with what expected;

(f5) keeping on if the check is positive; or stopping and reporting the problem by means of an alarm signal;

(f6) manually binding the wire to the spool; an operator starts the production by activating a specific command;

(f7) detecting the dancer position and transforming the measured value into a measure of wire tension based on the geometry and structure of the dancer;

(f8) calculating the servodiameter according to the spool data, the production data and the dancer position; and (f9) calculating the speed of the spool motor according to the servodiameter with the aim of maintaining a constant winding tension;

said method being characterized in that it comprises a further step for calculating the angular speed of a motor displacing the wire dispensing device according to the wire winding step and according to the dancer error, detected by a position sensor that provides an analogical signal with respect to a zero position and to a tolerance value, in order to determine the presence of a possible "valley error", or of a possible "peak error"; and in that if during the spool winding a "valley error" or a "peak error" is detected, the control device decides whether to slow down or to increase the speed of the wire dispensing device with the aim of filling the depression or skipping the peak.

2. Method according to claim 1, characterized in that it comprises a further step wherein the inversion of the wire dispensing device is calculated according to the spool flange position detected by the sensor during the spool loading and according to a detected dancer error; said error being used to determine the presence of a valley or of a peak, and therefore to increase or to reduce the inversion.

3. Method according to claim 1, characterized in that it comprises a further step for calculating the length of the wire wound on the spool.

4. Method according to claim 1, characterized in that it comprises at least a step of cable data transmission, or wireless transmission, to remote units for controlling the machine and/or the production line.

5. Machine for winding a wire on a spool, characterized in that it can implement a method for a correct winding of a wire on a spool according to claim 1.

* * * * *